US012378753B1

(12) United States Patent
Barba

(10) Patent No.: US 12,378,753 B1
(45) Date of Patent: Aug. 5, 2025

(54) WELL PUMP HOUSING AND TRANSPORTATION SYSTEM

(71) Applicant: Mike Barba, Paso Robles, CA (US)

(72) Inventor: Mike Barba, Paso Robles, CA (US)

( * ) Notice: Subject to any disclaimer, the term of this patent is extended or adjusted under 35 U.S.C. 154(b) by 0 days.

(21) Appl. No.: 18/672,022

(22) Filed: May 23, 2024

Related U.S. Application Data

(60) Provisional application No. 63/648,171, filed on May 15, 2024.

(51) Int. Cl.

| | |
|---|---|
| ***F04B 47/00*** | (2006.01) |
| ***E03B 5/06*** | (2006.01) |
| ***E04H 1/12*** | (2006.01) |
| ***F04B 17/06*** | (2006.01) |
| ***F04D 13/06*** | (2006.01) |
| ***F04D 15/00*** | (2006.01) |

(52) U.S. Cl.
CPC ..... *E03B 5/06* (2013.01); *E04H 1/1205* (2013.01); *F04B 17/06* (2013.01); *F04B 47/00* (2013.01); *F04D 13/06* (2013.01); *F04D 15/0011* (2013.01); *F04D 15/0066* (2013.01)

(58) Field of Classification Search
CPC ..... F04N 49/08; E04H 1/1205; F04B 17/06; F04B 47/00; F04B 49/08; F04D 13/06; F04D 15/0011; F04D 15/0066; F03B 5/06
See application file for complete search history.

(56) References Cited

U.S. PATENT DOCUMENTS 5,941,690 A * 8/1999 Lin ..... F04B 49/065 417/44.2
8,857,781 B2 10/2014 Wang et al.
(Continued)

FOREIGN PATENT DOCUMENTS

CN 208828301 U * 5/2019

OTHER PUBLICATIONS

Private Well Water System, published Jun. 18, 2021. URL: https://www.bonnerpropertiesgroup.com/node/6 (Year: 2021).*
(Continued)

*Primary Examiner* — Thomas Fink
(74) *Attorney, Agent, or Firm* — Sierra IP Law, PC; William K. Nelson

(57) ABSTRACT

The invention relates to a pre-configured portable well pump utility structure apparatus that offers an efficient water delivery solution and rapid installation in remote locations. The well-pumping system may be pre-configured for various water sources and may include a pump and motor assembly controlled by a system controller, typically incorporating a Variable Frequency Drive (VFD) for operation adjustment based on water demand. The well-pumping system may be secured in a utility structure for ease of transportation and deployment that is manufactured off-site and mounted on a skid frame or plate for stability. Advanced features such as wireless communication for remote system management, safety mechanisms for backflow prevention and pressure management, and a pressure transducer for continuous system optimization highlight the system's adaptability and operational efficiency. This modular, scalable solution addresses the critical need for reliable water access in challenging environments, underscoring its significance in enhancing water resource management practices.

5 Claims, 11 Drawing Sheets

(56) References Cited

U.S. PATENT DOCUMENTS

| | | | |
|---|---|---|---|
| 10,581,934 | B2 | 12/2020 | Haight |
| 11,103,903 | B2 | 8/2021 | Himebaugh et al. |
| 11,456,520 | B2 | 9/2022 | Moore et al. |
| 2012/0071702 | A1* | 3/2012 | Butler ..... B01J 19/008 422/162 |
| 2021/0075084 | A1 | 3/2021 | Moore et al. |
| 2022/0019182 | A1* | 1/2022 | Kallesoe ey al. ... F04D 15/0088 |
| 2022/0399631 | A1 | 12/2022 | Moore et al. |

OTHER PUBLICATIONS

Fluid Handling Skid Fabrication, published Nov. 27, 2023, URL: https://web.archive.org/web/20231127175035/https://www.mechequip.com/service/fluid-handling-skid-fabrication/#prettyPhoto (Year: 2023).*

Bonus! The world's nicest shed (aka our pump house), URL: https://www.youtube.com/watch?v=b0bL5K-IWGI, published Jun. 10, 2020 (Year: 2020).*

The Benefits of Three Phase AC Pumps for Solar Water Pumping, published May 17, 2021, URL: https://diysolarforum.com/threads/the-benefits-of-three-phase-ac-pumps-for-solar-water-pumping.22876/ (Year: 2021).*

Why Choose a VFD pump for domestic pressure boosting?, published Jan. 4, 2023, URL: https://www.streampumps.com/pump-introductions/16.html (Year: 2023).*

Well House Design, published Jun. 6, 2023, URL: https://www.carnationconstruction.com/Techniques/04-03-Techniques-PlotInfrastructure-WellHouseDesign.html (Year: 2023).*

Fluidall's Forklift Base for Mobile Storage Tanks, retrieved on Jan. 17, 2024, https://www.fluidall.com/portable/mobile-storage-tanks-forklift-base.

* cited by examiner

WELL PUMP HOUSING AND TRANSPORTATION SYSTEM

FIELD OF THE INVENTION

The present invention relates to a rapidly deployable structure housing a well pumping system designed to provide a reliable source of water for residential, agricultural, or industrial purposes, especially in areas where conventional water delivery systems are impractical or unavailable. More specifically, the deployable structure is preconfigurable for deep well application, surface boosting applications, and is constructed and assembled off-site.

BACKGROUND OF THE INVENTION

Remote sites often lack direct access to municipal water supplies, necessitating the installation of well pump systems to extract water from underground aquifers. These systems are critical for providing a reliable source of water for residential, agricultural, or industrial purposes in areas where conventional water delivery systems are impractical or unavailable.

The installation process of a well pump system at a remote site is not without its challenges. It involves several key steps, each presenting its own set of difficulties. Initially, a suitable site for the well must be identified through geological surveys and water table analysis to ensure an adequate and sustainable water source. This is followed by the transportation of drilling equipment to the location, a task that can be arduous due to the often rugged or undeveloped terrain. The drilling process itself is no easy feat, requiring specialized machinery and expertise to navigate through various soil layers and rock formations.

After the borehole is completed, a casing is installed to prevent the collapse of the borehole walls and to ensure that the water extracted is not contaminated by surface water or other pollutants. This step is critical for maintaining the integrity of the water source and the surrounding environment. Subsequently, the well pump, which is the heart of the system, is installed. The type of pump selected depends on factors such as the depth of the water table, the volume of water required, and the energy sources available at the remote site. Options include submersible pumps, which are placed directly in the water, and surface pumps, which are located above ground and lift water through suction.

The installation process also involves setting up a power supply for the pump, which can be challenging in remote areas. Options include connecting to the nearest electrical grid, if available, or utilizing alternative energy sources such as solar panels or wind turbines. Additionally, a storage system, typically a water tank, is installed to ensure a steady supply of water even during periods of low pump operation or maintenance.

Finally, the system is tested to ensure proper functioning, including the pump's ability to deliver water at the required volume and pressure consistently, and the overall system's reliability in varying environmental conditions. The installation of a well pump system at a remote site is a complex process that requires careful planning, specialized equipment, and expertise. However, once successfully installed, it provides a critical resource, enabling sustainable access to water in locations far removed from conventional infrastructure.

SUMMARY OF THE INVENTION

The present invention provides methods and systems for deploying a pumping apparatus. The present invention relates to a rapidly deployable structure housing a well pumping system operable to provide a reliable source of water for residential, agricultural, or industrial purposes, especially in areas where conventional installation of water delivery systems is impractical or unavailable. This portable well pump utility structure encompasses a comprehensive system including a water pumping system, a metal frame with a roof and walls, doors for technician access, and a base that can be either a skid frame or skid plate for easy positioning and secure installation. The ease of deployment is facilitated by the structure's design to be manufactured and assembled off-site and transported to the installation site using standard logistics equipment.

The present invention provides a water pumping system housed within the utility structure, comprising a pump and motor assembly controlled by a system controller, typically incorporating a Variable Frequency Drive (VFD) to adjust operation based on water demand. This ensures a consistent supply of water at the desired pressure. The system is designed to be flexible, capable of operating on single- or three-phase power, and potentially integrate alternative power sources such as solar arrays. Advanced features in the VFD may include wireless (e.g., WiFi) and Bluetooth (e.g., BLE6, BT) communications for remote monitoring and management, safety mechanisms to prevent backflow and manage excess pressure, and a pressure transducer for continuous monitoring and optimization of system pressure.

The water pumping system provides an advanced fluid control system designed to maintain optimal flow and pressure, incorporating components like a pressure tank to reduce pump cycling and a bypass maintenance line for uninterrupted service during repairs. A novel aspect of the invention includes the potential adaptation for submersible well pump configurations, accommodating deep well depths and ensuring efficient water delivery.

Moreover, the invention provides for modular expansion and pre-configuration, allowing users to enhance the system with additional features such as water filtration, heating, and remote control capabilities. It also accounts for environmental adaptability, with sensors to monitor conditions like temperature and humidity, ensuring system reliability across diverse geographical locations.

In some embodiments, the system may include a quick-connect manifold facilitating streamlined connections for electrical and water supply lines, emphasizing ease of maintenance and operational flexibility. This modular approach allows rapid installation and customization to meet specific site requirements.

In some embodiments, the present invention the fluid control system may be operable to modulate the pump motor's speed to regulate the flow and pressure of water, thereby facilitating energy-efficient pump operation and prolonging pump lifespan. The motor of the pump and motor assembly may be supplied with power by a three-phase power supply, ensuring it receives a consistent and regulated supply of electricity from the control system for efficient functioning. The system's pressure may be monitored by a pressure transducer sensor or similar sensor, which conveys pressure readings to the control system, enabling it to make real-time adjustments to the motor's operational parameters to maintain optimal pressure conditions.

An electrical panel capable of supporting both single and three-phase power inputs of 208/230 VAC with a variance of plus or minus 10% houses the electrical components and provides the electrical supply to the control system. This is facilitated by a power supply electrical line that channels electrical energy from the electrical panel to the control panel, thus empowering it to manage the pump and motor assembly. The system draws its primary electrical power from an electrical power source, which could be a municipal power grid or an alternative source, ensuring that the electrical panel and the complete system are adequately powered. In some embodiments, the electrical panel may include circuit breakers or fuses that protect circuits from overloading, a main breaker that controls the power supply to the entire panel, bus bars for distributing power to individual breakers, and neutral bars connected to the neutral wire to complete the circuit. Grounding bars are also crucial and may provide a safe path for excess electricity to disperse, usually into the earth. Additionally, the electrical panel may contain surge protectors to shield devices from voltage spikes, a service disconnect switch allowing for the entire power supply to be cut off for maintenance, and various types of relays and contactors for controlling large loads. Indicator lights and meters for monitoring voltage, current, and power quality are often present, aiding in diagnostics and system management. The electrical panel may further provide GFCI switches and outlets and provide power to a light source, a Climate controller, a heat lamp, and a submersible pump control box. The electrical line may be grounded to the utility structure frame.

A pressure tank within the system functions to store pressurized water, acting as a buffer to reduce the frequency of pump operation cycles and stabilize the pressure throughout the distribution network. The pump and motor assembly, which comprises a pump linked with a motor, receives power and control signals from the control system, maintaining the requisite water pressure and flow. The water supply to the system may originate from various sources, such as a well, reservoir, or municipal water supply line. The system is designed with a check valve to prevent the backflow of water, thus shielding the pump and motor assembly from potential water hammer and reverse operation scenarios. A ball valve is also incorporated, allowing for manual isolation of the system for maintenance and repair activities without necessitating a complete system shutdown.

For safety, a pressure relief valve may be included to protect against excessive pressure by discharging water when the pressure exceeds a predetermined safety limit. The system pressure is visibly indicated by a pressure gauge, which permits manual monitoring and system adjustments as necessary. Additionally, the water control system receives real-time pressure data from a pressure transducer or sensor, which is essential for the system's dynamic operational adaptation to ensure consistent pressure levels. A bypass maintenance line may be provided to allow for maintenance and repair work without interrupting the typical flow path, thereby minimizing any system downtime. The system culminates with a water output, which is the juncture where the pressurized water is distributed for consumption or use. In some embodiments, various float switches may be positioned along the conduits and water to activate or deactivate electrical circuits once a flow of water has reached a specified level. For example, not limiting the invention, a float switch may be incorporated at or near the water intake conduit to safeguard the pump and motor assembly in the of insufficient water supply, a flow switch between the pump and the pressure tank can help monitor and control the flow of water into the tank, a flow switch installed before the water output conduit can help monitor the water being distributed to the building or connected site. If the apparatus includes a water filtration system, integrating a flow switch can help monitor water flow through the filters. In such implementation, the float switches may be in communication with the electrical panel and water control system. The float switches may be mechanical float switches (e.g., vertical float, horizontal), magnetic float switches (e.g., single-point, multi-point), optical, capacitive, ultrasonic, pneumatic, or electronic float switches.

The advanced water control system, of the present invention may be configured for residential applications, featuring a versatile and expandable configuration that accommodates a range of additional functionalities. The modular water pumping system may integrate features such as water filtration, heating, and remote control capabilities to enhance utility and user experience. The system may adapt to various environments by including sensors capable of monitoring extreme conditions like temperature, humidity, or salinity, thus ensuring reliability and longevity in diverse geographical settings.

The invention encompasses a water control system that may seamlessly integrate with both surface-level water storage and well systems. The system includes a variable frequency drive (VFD) that intelligently manages the operation of pumps based on water level measurements provided by multiple float switches. These switches activate to maintain optimal water levels or to trigger emergency shutoffs to prevent system overloads. Additionally, the VFD is capable of adjusting water flow and pump operation in response to real-time water demand and storage conditions.

The system's design includes a high-capacity water storage tank, interconnected with a submersible well pump and a surface pressure boosting pump. This configuration allows for efficient water management and supply to residential structures, supported by sophisticated monitoring devices such as pressure transducers that further refine system performance based on output requirements. The water control system is designed to provide a reliable, efficient, and adaptable solution for managing residential water supply needs, emphasizing ease of integration and operational flexibility.

It is an aspect of the invention to provide a portable well pump utility apparatus that includes a utility housing manufactured and assembled off-site and mounted to a skid frame. The skid frame may be designed to elevate the utility structure off the ground for easy transportation and positioning. This housing features at least three walls, a roof, and a floor, alongside a pre-configured water pumping system. This system may include a water intake conduit coupled to a water well, a pump and motor assembly operable to pump water from the well to a pressure tank and a water output conduit, a pressure transducer and a pressure relief valve coupled to the water output conduit, and a system controller in communication with the pressure transducer and pump and motor assembly. An electrical panel may be secured to the utility housing and connected to a power source through a power input electrical line, which may provide power to the system controller. The utility housing may include a metal frame forming the primary structure, with the floor secured inside of this structure, the roof secured to an upper roof frame, and the walls removably secured around the exterior of the metal frame. This housing may also include a pair of doors or a single door to provide technicians with access to the water pumping system for maintenance and servicing.

In related aspects, the present invention provides a system controller within the apparatus that may include a Variable Frequency Drive (VFD) system. This system may provide three-phase power to the pump and motor assembly and adjust the assembly's speed in response to water demand from a building or site, ensuring a consistent water supply at a desired pressure. The system controller may include wireless communication capabilities and can interface with a server web application and a phone application for remote monitoring and management of the water pumping system.

Additionally, it is an aspect of the invention to incorporate a pressure transducer coupled to the water output conduit, capable of continuously monitoring water pressure within the system. The system controller may be operable to dynamically adjust the pump and motor assembly's speed based on the pressure data received from the pressure transducer. The water pumping system may further include a pressure tank to reduce the activation frequency of the pump and motor assembly, along with a check valve, flow switches, and a pressure relief valve to prevent backflow and manage excess pressure. The housing may further encompass a utility housing skid frame mounted to a skid plate, allowing for easy adjustments to the housing's position at a water well site. The water pumping system may also include a water filtration system, a water heating system, and a moisture detection sensor, all in communication with the system controller. The utility housing may include mounting plates for the electrical panel and system controller, with each plate coupled to a vertical member of the frame via a swivel hinge, facilitating adjustable positioning for ease of access and transportation. The utility housing's walls may be removable for maintenance, repairs, and customization of the exterior surface finish to match environmental or aesthetic requirements. In some implementations, a manifold may be configured to allow rapid connection and disconnection of the water pumping system's input and output conduits and power input electrical line.

It is another aspect of the invention to provide a method for installing a portable well pump utility structure that involves transporting a skid-mounted utility structure housing a water pumping system to an installation site, positioning and securing the structure to the ground near a water well and connection site, and connecting the well water line and water output conduit to the system. Connecting a power source to an electrical panel that provides power to a water pump control system, activating the control system to engage and adjust the pump and motor assembly speed in response to water demand. Securing the utility structure to the ground may involve anchoring the skid frame using anchor bolts, with the water pumping system configured to adjust the pump and motor assembly operation based on real-time data from a pressure transducer to maintain optimal water pressure and flow.

Lastly, it is an aspect of the invention to offer a modular portable well pump utility system designed for rapid deployment and ease of use in various environments. This system features an assembly structure with a metal frame, roof, and walls for off-site manufacturing and on-site deployment, a water pumping system with a connection manifold, and a system controller with wireless communication for remote monitoring and control. The skid frame mounted below the assembly structure facilitates easy positioning and deployment, with an integrated electrical panel connected to a power source ensuring power provision to the system controller. The assembly structure may further comprise additional systems like water filtration, heating, pressure tank, water storage tank, or water softener, each in electrical communication with the system controller. The motor and pump assembly can vary between a submersible water pump, a surface pressure boosting pump, or both, with specific configurations for coupling outputs and intakes as well as independent calibration of pump flow rates based on real-time data from pressure transducers.

Further aspects and embodiments will be apparent to those having skill in the art from the description and disclosure provided herein.

It is therefore an object of the present invention to provide a portable and rapidly deployable well pump utility apparatus that is easily transported and deployed at the installation site, making it ideal for providing a reliable water source in areas where conventional water delivery systems are impractical or unavailable.

It is also an object of the present invention to provide a pre-configured water pumping system within a utility housing mounted to a skid frame, the invention simplifies installation and setup, making it accessible for use in residential, agricultural, or industrial settings without requiring specialized skills.

It is also an object of the present invention to provide a modularly configurable water pumping system with removable walls of the utility housing to enable customization and expansion of the system. This allows for the addition of components such as water filtration systems, heating systems, and moisture detection sensors, tailoring the apparatus off-site to meet specific water supply needs.

Other objects of the present invention will be apparent from the detailed description and the claims herein.

The above-described objects, advantages, and features of embodiments of the invention, together with the organization and manner of operation thereof, will become apparent from the following detailed description when taken in conjunction with the accompanying drawings, wherein like elements have like numerals throughout the several drawings described herein. Further benefits and other advantages of the present invention will become readily apparent from the detailed description of the preferred embodiments.

DETAILED DESCRIPTION OF THE INVENTION

Reference will now be made in detail to certain embodiments of the invention, examples of which are illustrated in the accompanying drawings. While the invention will be described in reference to these embodiments, it will be understood that they are not intended to limit the invention. To the contrary, the invention is intended to cover alternatives, modifications, and equivalents that are included within the spirit and scope of the invention. In the following disclosure, specific details are given to provide a thorough understanding of the invention. However, it will be apparent to one skilled in the art that the present invention may be practiced without all of the specific details provided.

With reference to the figures where like elements have been given like numerical designations to facilitate the reader's understanding of the present invention, the preferred embodiments of the present invention are set forth below. The enclosed figures are illustrative of several potential preferred embodiments and, therefore, are included to represent several different ways of configuring the present invention. Although specific components, materials, configurations and uses are illustrated, it should be understood that a number of variations to the components and to the configuration of those components described herein and shown in the accompanying figures can be made without changing the scope and function of the invention set forth herein. For instance, although the description and figures included herewith generally describe and show the new portable well pump and utility structure of the present invention, as well as various configurations of the well pump and auxiliary systems, those who are skilled in the art will readily appreciate that the present invention is not so limited.

Figure 1:
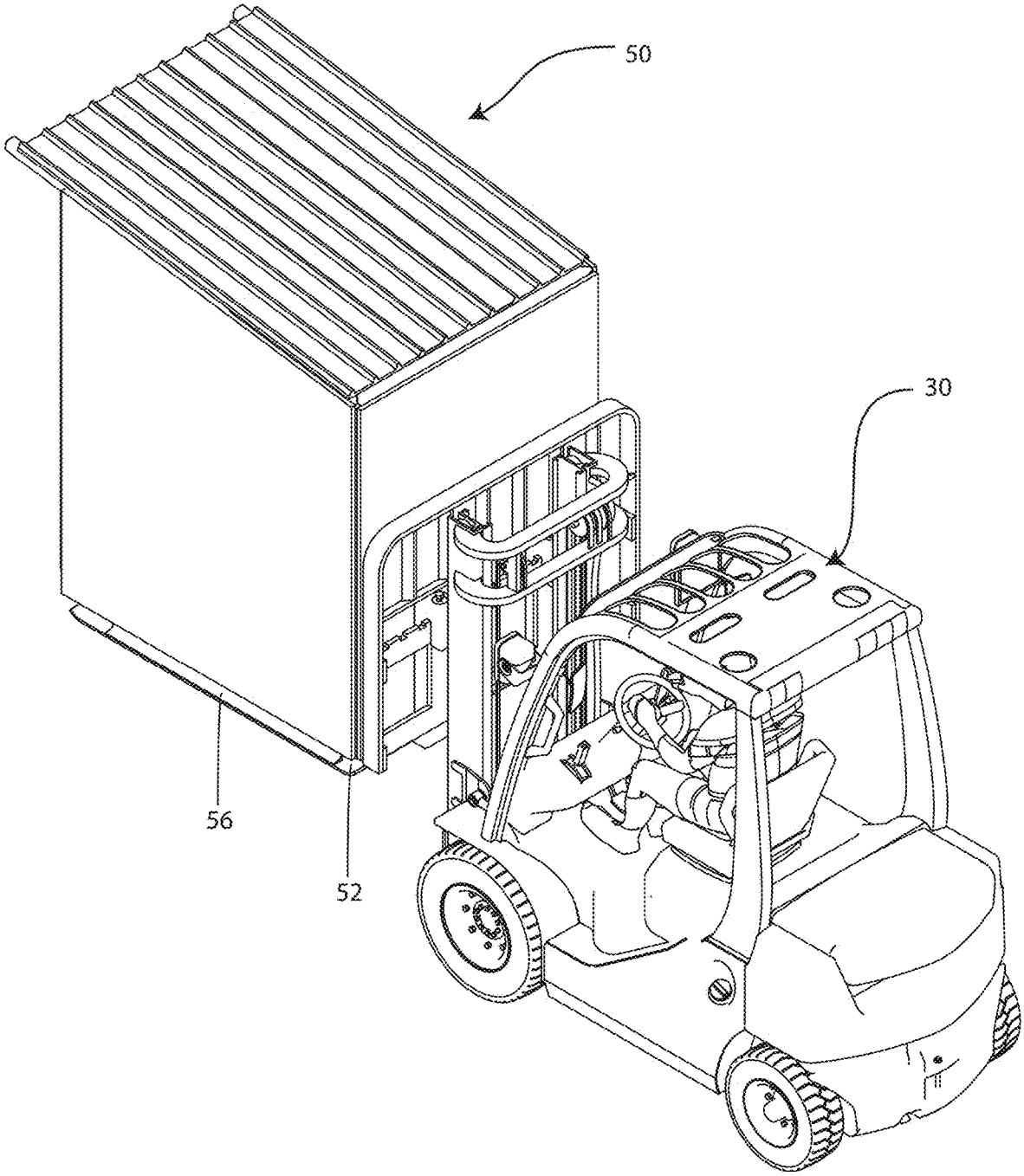
FIG. 1 is a portable well pump utility structure transported by a vehicle, according to an embodiment of the present invention.
Figure 2:
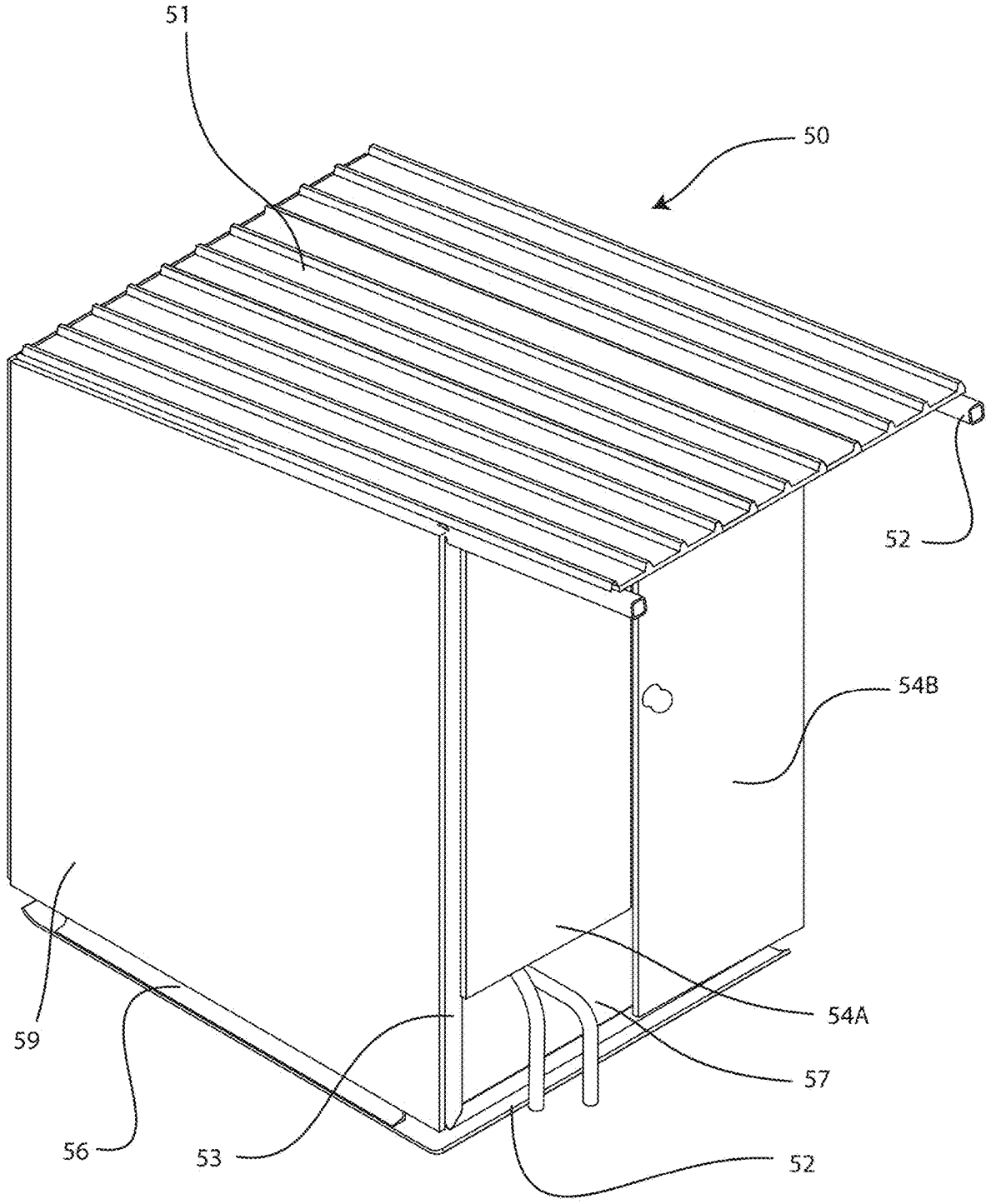
FIG. 2 is an exemplary view of a well pump utility structure, according to an embodiment of the present invention.
Figure 3:
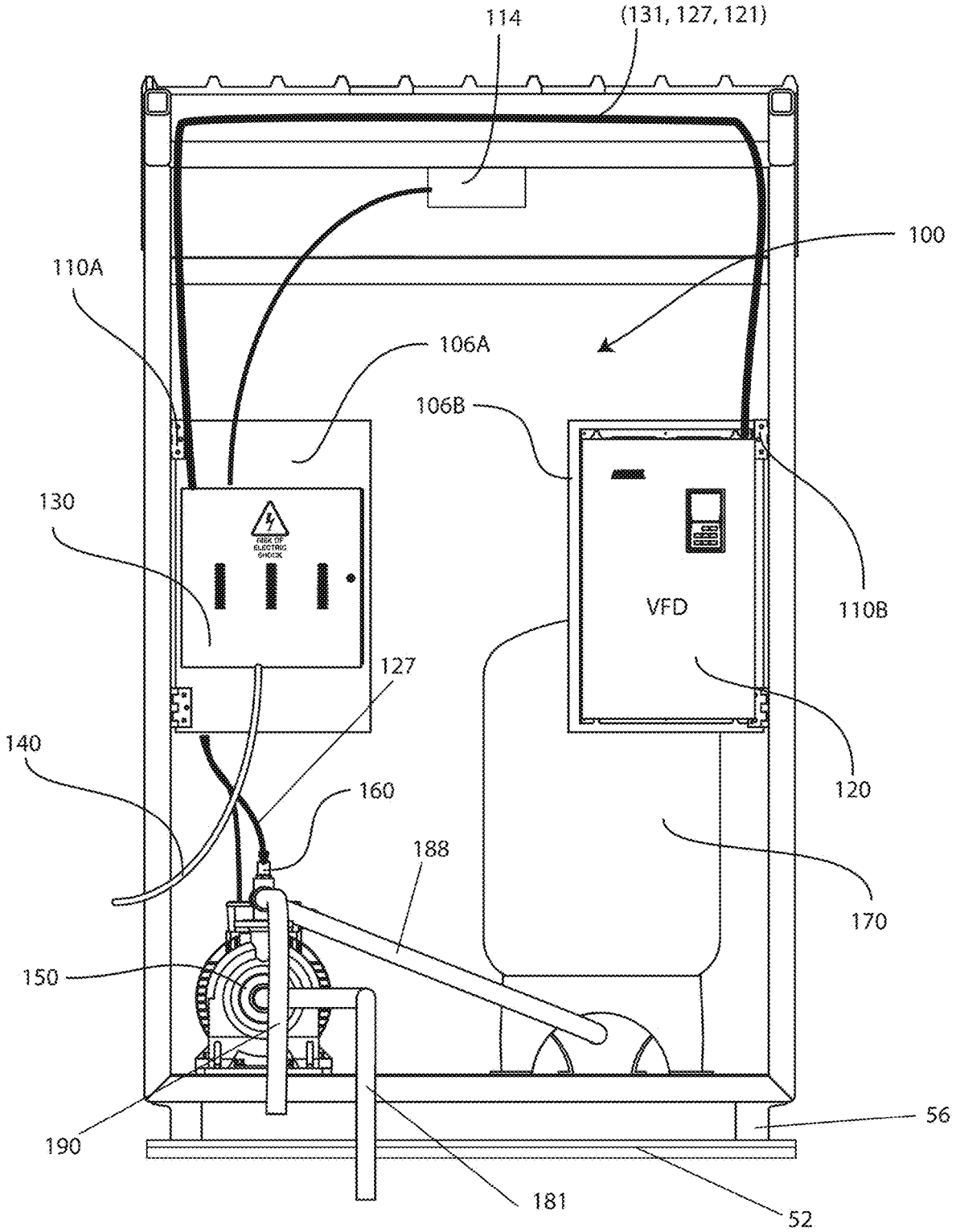
FIG. 3 is an exemplary front view of the well pump utility structure and water pumping system, according to an embodiment of the present invention.
Figure 4:
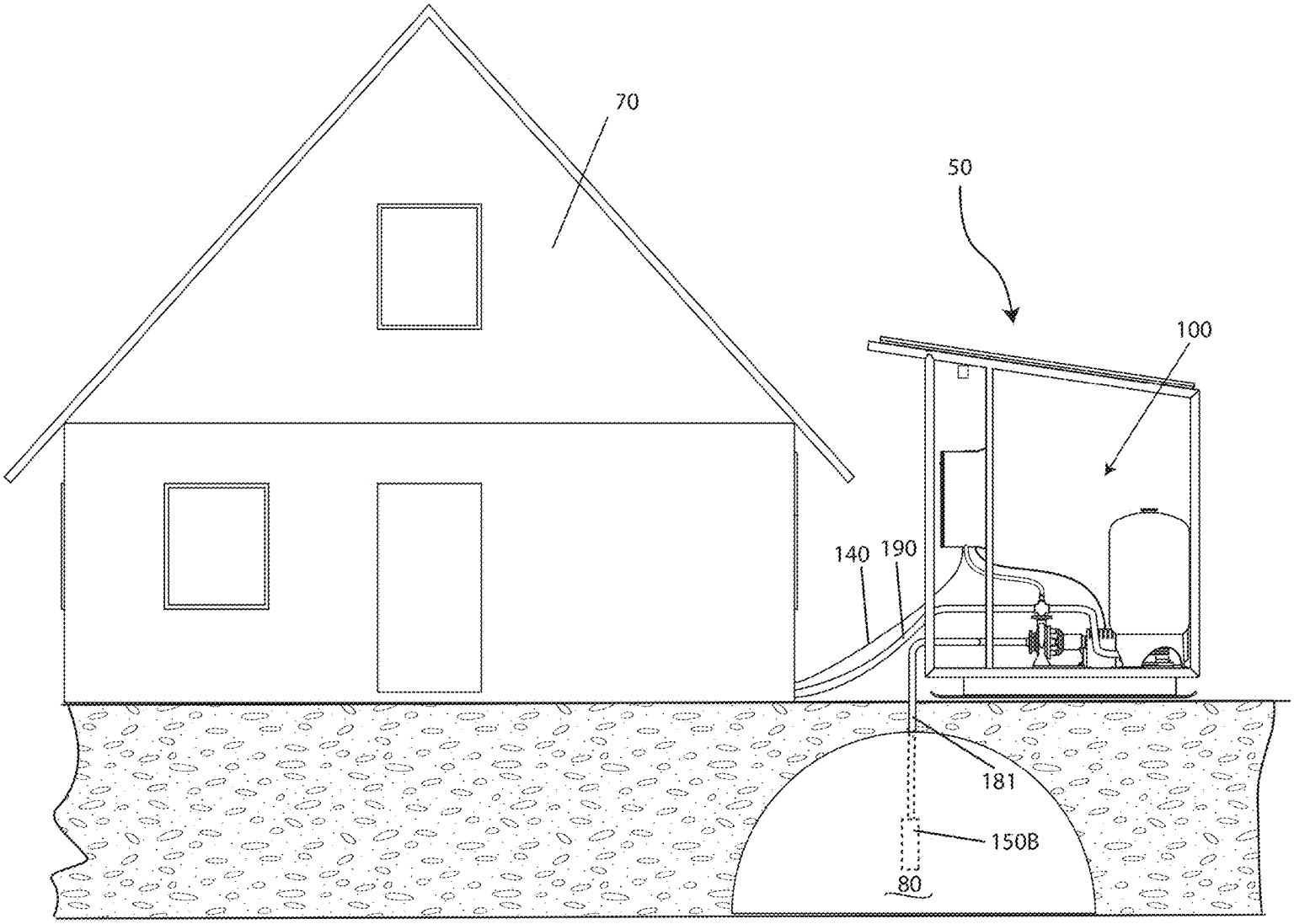
FIG. 4 provides an exemplary environmental view of a well pup utility structure in communication with a water well and a residential structure, according to an embodiment of the present invention.

The present invention concerns a portable well pump utility structure housing a water pumping system that is connected to a water well and is operable to provide a reliable source of water for residential, agricultural, or industrial purposes in areas where conventional water delivery systems are impractical or unavailable. FIG. 4 provides a view of the well pump utility structure 50, housing a water pumping system 100 and interfaced with a water well 80 and a building 70. In some embodiments, the utility structure 50 and water pumping system 100 may be manufactured and assembled off the installation site. In such embodiments, as illustrated in FIG. 1, the system may be transported by a forklift crane or other similar vehicle 30. This aspect underscores the invention's design for ease of deployment. As illustrated in FIG. 2, the utility structure 50 may include a metal frame 53, a floor 57, a roof 51 secured to an upper roof frame 52, and the system may have walls 59 positioned around the exterior and doors (54A, 54B) to allow technician access to the water pumping system 100. In some embodiments, the floor 57 may have a bottom surface with a rubberized or textured lining to prevent unwanted critters from nesting thereunder. In some embodiments, the utility structure 50 may be mounted on a skid frame 56 that is operable to raise the utility structure 50 off the ground and may include anchor points (not shown) for fastening the utility structure 50 to a concrete slab or footing. In other embodiments, the utility structure 50 may be mounted onto a skid plate 52 that is operable to allow the structure 50 to be slid into the desired position. In another embodiment, the skid frame 56 may be mounted on top of a skid plate 52 and may have exterior anchor points along the periphery of the skid plate for fastening the utility structure 50 to the ground.

As illustrated in FIG. 3-FIG. 7, the water pumping system 100 may include a pump and motor assembly 150 managed by a system controller 120—typically a Variable Frequency Drive (VFD) system that is operable to adjust the speed of the pump and motor assembly 150 in response to the water demand from the residential structure 70, ensuring a consistent supply of water at the desired pressure. The system controller 120 may be connected to a power source through an electrical panel 130 and may be operable to intake either single or three-phase power, accommodating a range of power supply scenarios. The electrical panel 130 receives power through a power input line 140 from an electrical power source, such as a local grid connection or an alternative power supply. The electrical panel may further include GFCI switches and outlets, breakers, and provide power to a light source 114. In some embodiments, the power input line 140 may be in communication with a solar array and battery storage system. In some embodiments, the controller 120 may include wireless communication and may be in communication with a server web application client and phone application displaying historical and current information and data related to the operation and status of the water pumping system. Data may include water flow characteristics, power consumption, water reserves, and overall system efficiency.

In some embodiments, the water pumping system 100 may include a pressure transducer 160 (e.g., sensor) to continuously monitor the water pressure within the system. This component monitors system pressure, facilitating real-time adjustments via the controller 120 to maintain optimal conditions. Safety mechanisms, including a check valve 182 and a pressure relief valve 184, are crucial for preventing backflow and managing excess pressure, respectively. In such embodiments, the transducer 160 sensor data is relayed to the system controller 120, which is operable to dynamically adjust the pump's operation to maintain the optimal pressure, enhancing the efficiency of the pump and motor assembly 150 based on the system controller 120 calibrations. The water pumping system may include a pressure tank 170 to mitigate the frequency of pump activation cycles, thereby reducing wear and promoting longevity. The water pumping system 100 may include safety components such as a check valve 182 to prevent backflow and a pressure relief valve 184 to release excess water if the pressure exceeds safe levels, thus safeguarding the system's integrity.

Figure 5A:
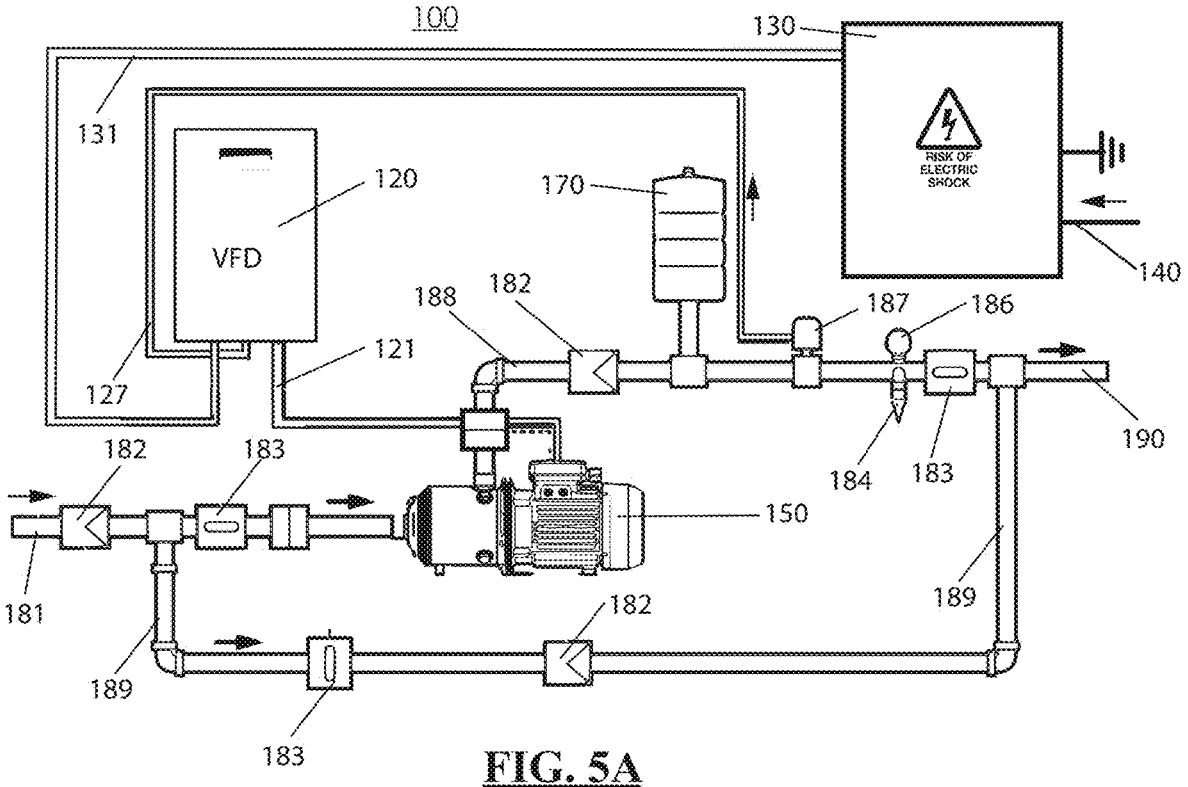
FIG. 5A provides a flow diagram of a water pumping system, according to an embodiment of the present invention.

In operation, as best illustrated in the flow diagram of FIG. 5A, the present invention provides an advanced fluid control system operable to maintain optimal flow and pressure of water within a distribution network. The system controller 120 orchestrates the operation of a pump and motor assembly 150 in a surface pressure boosting configuration. The system controller 120 receives power from a single-phase power supply electrical line 131 emanating from an electrical panel 130, which is connected to an electrical power input line 140. The system controller 120 may be operable to provide three-phase power to the motor and pump assembly 150 via the electrical power and control line 121. The system controller 120 may further provide power and receive readings from the pressure transducer 187 via the electrical line 127.

As water enters the system from the water well 80 via the water supply line 181, it is directed through a series of flow regulation components, including a check valve 182 that ensures unidirectional flow and a ball valve 183 for manual flow interruption. The pump and motor assembly 150 then propel the water through the system, with its speed being finely tuned by the system controller 120 to control the pressure based on real-time feedback from the pressure transducer 187. To safeguard against overpressure, a pressure relief valve 184 may be placed downstream of the pump, ready to discharge excess water if needed. The system's pressure may be continuously monitored by a sensor or pressure transducer 187, which is in communication with the control system 120 to enable responsive adjustments to the pump's operational parameters. Additionally, a pressure gauge 186 provides a manual (e.g., analog, digital, etc.) pressure readout for system monitoring. A pressure tank 170 is incorporated to store pressurized water, effectively reducing pump cycling frequency and ensuring consistent pressure within the network. A bypass maintenance line 189 is available for system servicing or operational modifications, allowing for continued system operation during maintenance activities. The system culminates at the water output 190, where the pressurized water is finally dispensed for use to the residential building 70.

The feedback loop from the pressure transducer 187 to the control system 120, allowing for real-time control of the pump and motor assembly 150 and thus, fluid flow and pressure. The provision of such dynamic control capabilities exemplifies the system's innovative approach to managing water distribution efficacies.

Figure 5B:
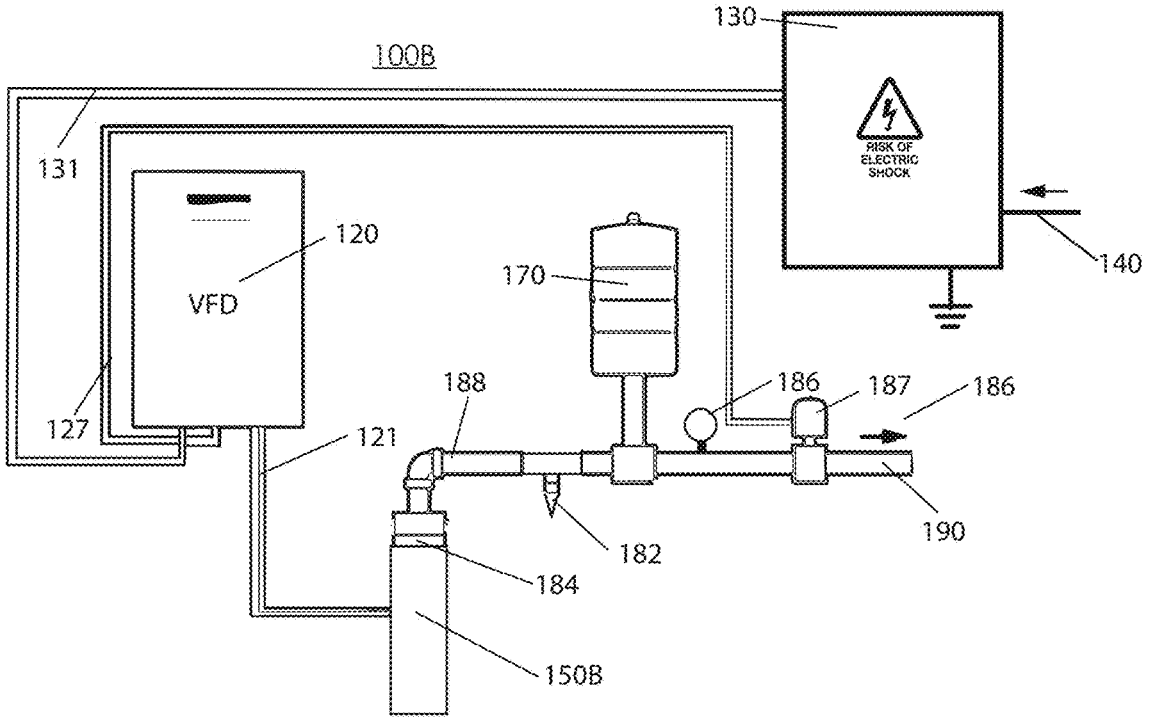
FIG. 5B provides a submersible pump flow diagram of the water pumping system, according to an embodiment of the present invention.
Figure 5C:
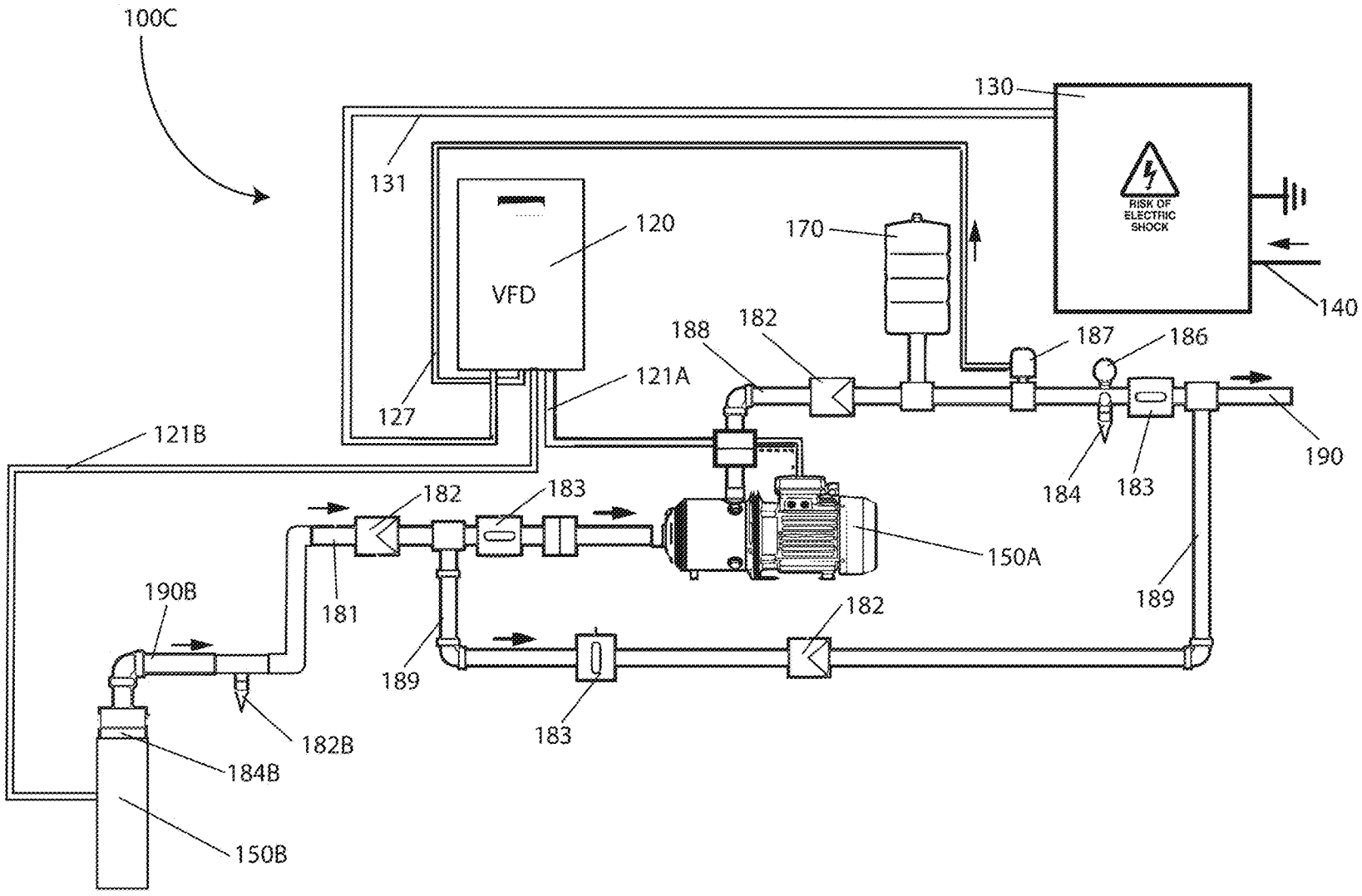
FIG. 5C provides a flow diagram of a combination submersible pump and surface booster pump, according to an embodiment of the present invention.

In some embodiments, as illustrated in the flow diagram of FIG. 5B, the water control system 100B may be adapted for a submersible well pump 150B that is positioned in the water well 80 and may include hydraulic stages that are operable to output a high water and pressure output for deep well depths. In such implementations, the submersible well pump 150B may include an integrated check valve 184 and is in communication with the controller 120 via the communication and power line 121. The pumped water may travel along conduit 188 to tank 170, and pressure relief valve 182 may be positioned therebetween. A pressure transducer 187 may be positioned after the water tank 170 to monitor the water output 190 to the residential structure 70. In such embodiments, the pressure transducer 187 communicates with the system controller 120 to perform calibration calculations and adjust the well pump characteristics based on desired water output demands.

In some embodiments, the water pumping system 100 may include a bypass maintenance line 189 for conducting repairs or maintenance without disrupting the water supply, and a pressure gauge 186 for manual pressure monitoring, as shown in FIG. 5A. The water output 190 of the pumping system 100 is designed to connect seamlessly with the residential plumbing, delivering potable water as needed. This portable well pump utility structure 100 thus presents a self-contained, versatile solution for supplying potable water to residential structures from a water well 80, ensuring reliability and ease of use. For maintenance or in case of a bypass need, the ball valve 183 between the bypass maintenance line 189 and the motor and pump assembly 150 is shut, thereby closing off flow through the motor 150, control system 120, and tank 170. To continue the flow along the maintenance line 189, the ball valve 183 on the bypass maintenance line 189 is opened, allowing for flow through the line to the water output line 190, allowing for repairs or maintenance without interrupting the service. Finally, the water output 190 is the endpoint where the controlled and pressurized water is delivered for usage to the residential structure 70.

In some embodiments, as illustrated in the flow diagram of FIG. 50, the water control system 100C may be adapted for a combination submersible well pump 150B and surface pressure boosting water pump and motor assembly 150A. In such embodiments, the submersible well pump 150B is positioned in the water well 80 and may include hydraulic stages that are operable to output a high water and pressure output for deep well depths. In such implementations, the submersible well pump 150B may include an integrated check valve 184B and is in communication with the controller 120 via the communication and power line 121B and the pumped well water may travel along conduit 190B to the input conduit 181 and pressure relief valve 182B may be positioned therebetween. The above surface pump and motor assembly 150A may include a pressure transducer 187, which may be positioned after the water tank 170 to monitor the water output 190 to the residential structure 70. In such embodiments, the pressure transducer 187 is in communication with the system controller 120 to perform calibration calculations and adjust the well pump characteristics based on desired water output demands. In such embodiments, the system controller 120 may independently adjust the speed of the submersible well pump 150B and the motor and pump assembly 150A based on water output and the most efficient combination.

In some embodiments, the water controller 120 may include an energy-optimizing module with an advanced algorithm that can predict water usage patterns and adjust the pump operation and tank water output. The controller may also include an enhanced monitoring module, such as predictive maintenance alerts based on the analysis of historical operation data, and may involve machine learning algorithms to predict potential system failures before they occur.

In some embodiments, the water pumping system 100 may include a modular design allowing for expansion to the system, enabling users to add additional features such as water filtration (e.g., Reverse osmosis system, Saltwater free water filtration), heating, remote control capabilities, within the structure 50. In some embodiments, the water pumping system 100 may be pre-configured with the above additional features. In some embodiments, the system controller 120 may include various sensors that may be operable to monitor specific environmental conditions, such as extreme temperatures, high humidity, or saline environments, to ensure the system's reliability and longevity in diverse geographical locations.

Figure 5D:
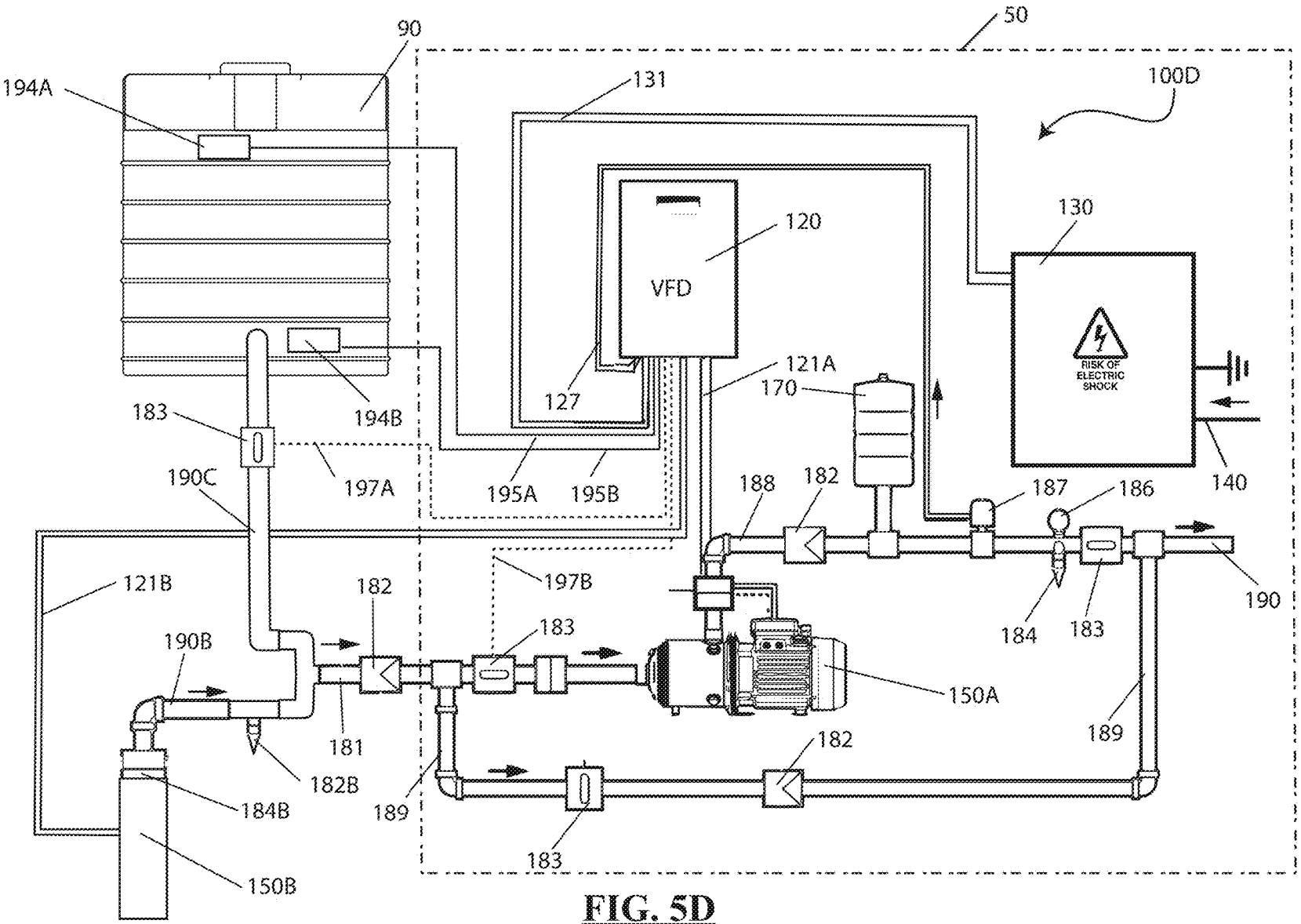
FIG. 5D provides a flow diagram of a combination submersible pump and surface booster pump incorporating a surface-level water tank, according to an embodiment of the present invention.

In some embodiments, as illustrated in FIG. 5D, the water control system 100D may be operably incorporated into applications having a surface-level water storage tank 90, a water well 80, and a residential building 70. In such applications, the water storage tank 90 may store water from the water well 80 and provide water to the surface pressure boosting water pump and motor assembly 150A, thereby the residential building 70. The water storage tank 90 may have a capacity ranging from 2500 gallons to 7500 gallons and may have a conduit 1900 that communicates with the submersible water pump conduit 190B and the water input conduit 181. The water storage tank 90 may have a first float switch 194A that is operable to measure an upper level of fluid and a second float switch 194B that is operable to measure a lower level of fluid, each float switch (194A, 194B) may be in electrical communication with the VFD via the electrical line (195A, 195B), respectively.

The first float switch 194A may measure the water level of the tank 90, and the VFD 120 may monitor the water level and engage the submersible well pump 150B to maintain the optimal water level. In some embodiments, the first float switch 194A may be in communication with a submersible control box module or secondary VFD (not shown). The second float switch 194B may be configured as an emergency shutoff that is in communication with VFD 120 when the float switch 194B switches state the VFD may disengage the water pump and motor assembly 150A. In some implementations, the inlet conduit 181 ball valve 183 may be in electrical communication with the VFD via line 197, and the tank conduit may have a ball valve 183 that is in electrical communication with the VFD via line 197B. When filling the tank 90 the VFD may configure the inlet conduit 181 ball valve 183 in a closed configuration and may engage the submersible water pump 190 and provide potable water to the storage tank 90. The first float switch 194A may measure the water level, and the VFD may shut off the submersible pump 150B and reengage the ball valve 183 to an open configuration. In some embodiments, the VFD 120 may disengage the water supply from the tank 90 by shutting the ball valve 183 into an off position via the electrical line 197A and may provide potable water directly to the inlet conduit 181 using only the water provided from the submersible well pump 150B. In such implementations, the submersible well pump 150B may include an integrated check valve 184B and is in communication with the controller 120 via the communication and power line 121B and the pumped well water may travel along conduit 190B to the input conduit 181 and pressure relief valve 182B may be positioned therebetween. The above surface pump and motor assembly 150A may include a pressure transducer 187, which may be positioned after the water tank 170 to monitor the water output 190 to the residential structure 70. In such embodiments, the pressure transducer 187 communicates with the system controller 120 to perform calibration calculations and adjust the well pump characteristics based on desired water output demands. In such embodiments, the system controller 120 may independently adjust the submersible well pump 150B speed and the motor and pump assembly 150A based on water output and the most efficient combination.

Figure 5E:
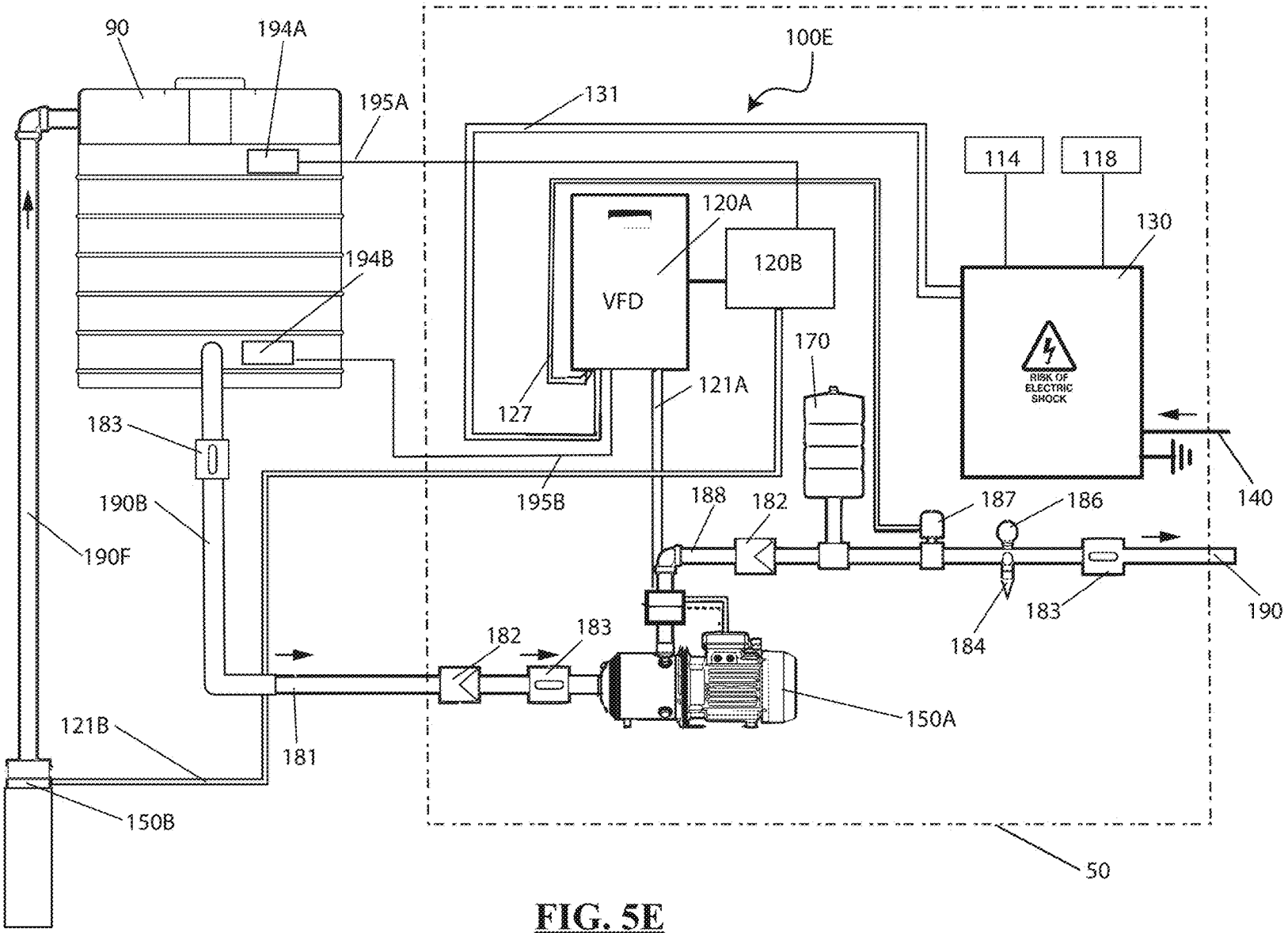
FIG. 5E provides a simplified flow diagram of a combination submersible pump and surface booster pump incorporating a surface-level water tank, according to an embodiment of the present invention.
Figure 6:
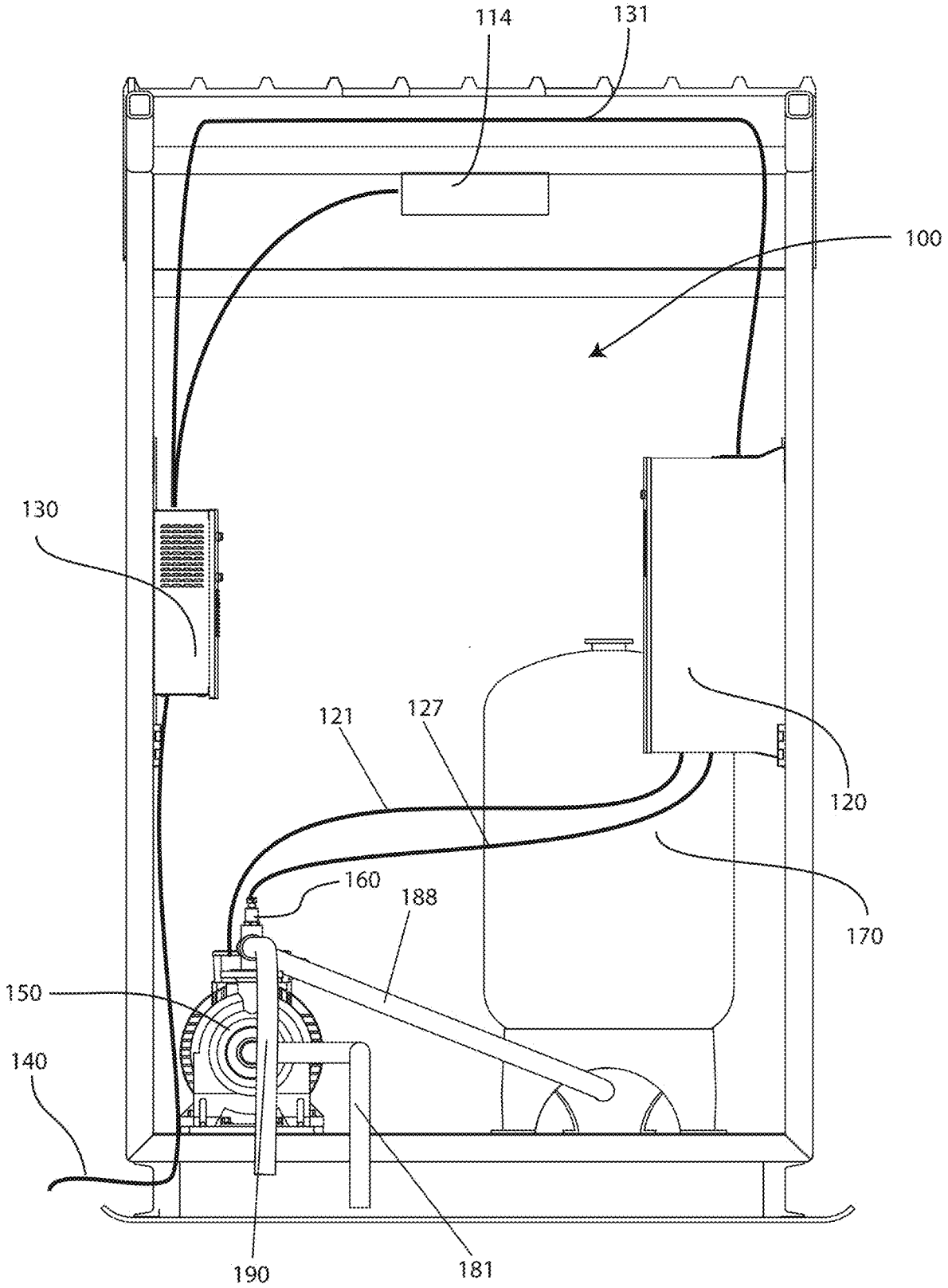
FIG. 6 is an exemplary front view of the well pump utility structure and water pumping system, according to an embodiment of the present invention.
Figure 7:
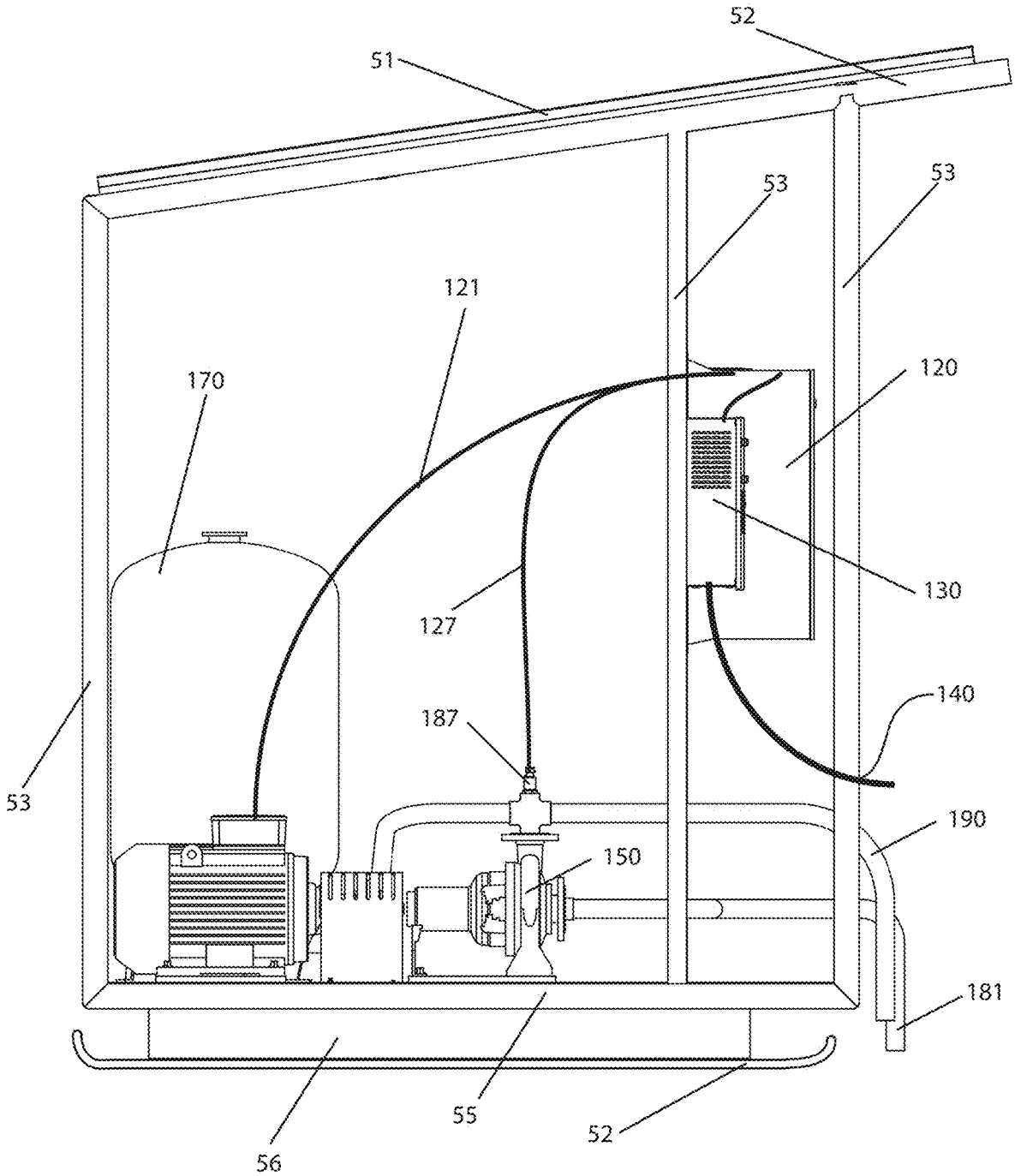
FIG. 7 is an exemplary side view of the well pump utility structure and water pumping system without the walls, according to an embodiment of the present invention.

In a simplified embodiment, as illustrated in FIG. 5E, the water control system 100E may be operably incorporated into applications having a surface-level water storage tank 90, a water well 80, and a residential building 70. In such embodiments, the water control system 100E may include a submersible well pump 150B and a surface pressure boosting water pump and motor assembly 150A, in electrical communication with a VFD 120. The VFD 120A may include a submersible control box module 120B or may be in communication with an independent submersible control box 120B. The VFDs (120A, 120B) may also be in communication with a first and second flow switch (194A, 194B) in the water tank 90, a pressure transducer 187, and receive power from the electrical panel 130. The first float switch 194A, may be an upper float switch with a conduit 195A and wires running to a submersible control box 120B or VFD 120A to turn the submersible pump 150B on or off. The second float switch 194B, may be a lower float switch with a conduit 195B and wires running to the VFD 120A to control the pump and motor assembly 150A. In other embodiments, the float switches (194A, 194B) may be mechanical float switches (e.g., vertical float, horizontal), magnetic float switches (e.g., single-point, multi-point), optical, capacitive, ultrasonic, pneumatic, or electronic float switches. The water storage tank 90 may store water from the water well 80 and provide water to the surface pressure boosting water pump and motor assembly 150A, thereby, the residential building 70. The water storage tank 90 may receive water from the conduit 190F, which is pumped from the submersible water pump 150B. The tank 90 may also have a water output conduit 190B, which provides water to the input conduit 181. The electrical panel 103 may include auxiliary power systems 118 including a GFI/GFCI outlet, climate controller, a heat lamp or heat pump, and the utility structure lighting 114.

In some embodiments, the utility structure 50 may include mounting plate 106A that is coupled to a vertical member of the frame 53 via a swivel hinge 110A. The mounting plate 106A may be operable to secure the electrical panel 130. Similarly, a mounting plate 106B may be coupled to a vertical member of the frame 53 via a swivel hinge 110B. The mounting plate 106B may be operable to secure the system controller 120. In such embodiments, the mounting plates (106A, 106B) may be configurable between an open and closed position as illustrated by comparing FIG. 3 and FIG. 6. The mounting plate (106A, 106B) closed configuration of FIG. 6 may be ideal for transporting the system, thereby preventing movement or damage to the panels, and the open configuration of FIG. 3 may be suited for normal operation and ease of access to water pumping system 100. In other embodiments, the walls 59 may be removable to allow technicians access to the system's hard-to-reach regions. In some embodiments, the utility structure 50 panels may be prepared for surface finishing (e.g., stucco, plaster, siding, etc.) and may include a roof.

Figure 8:
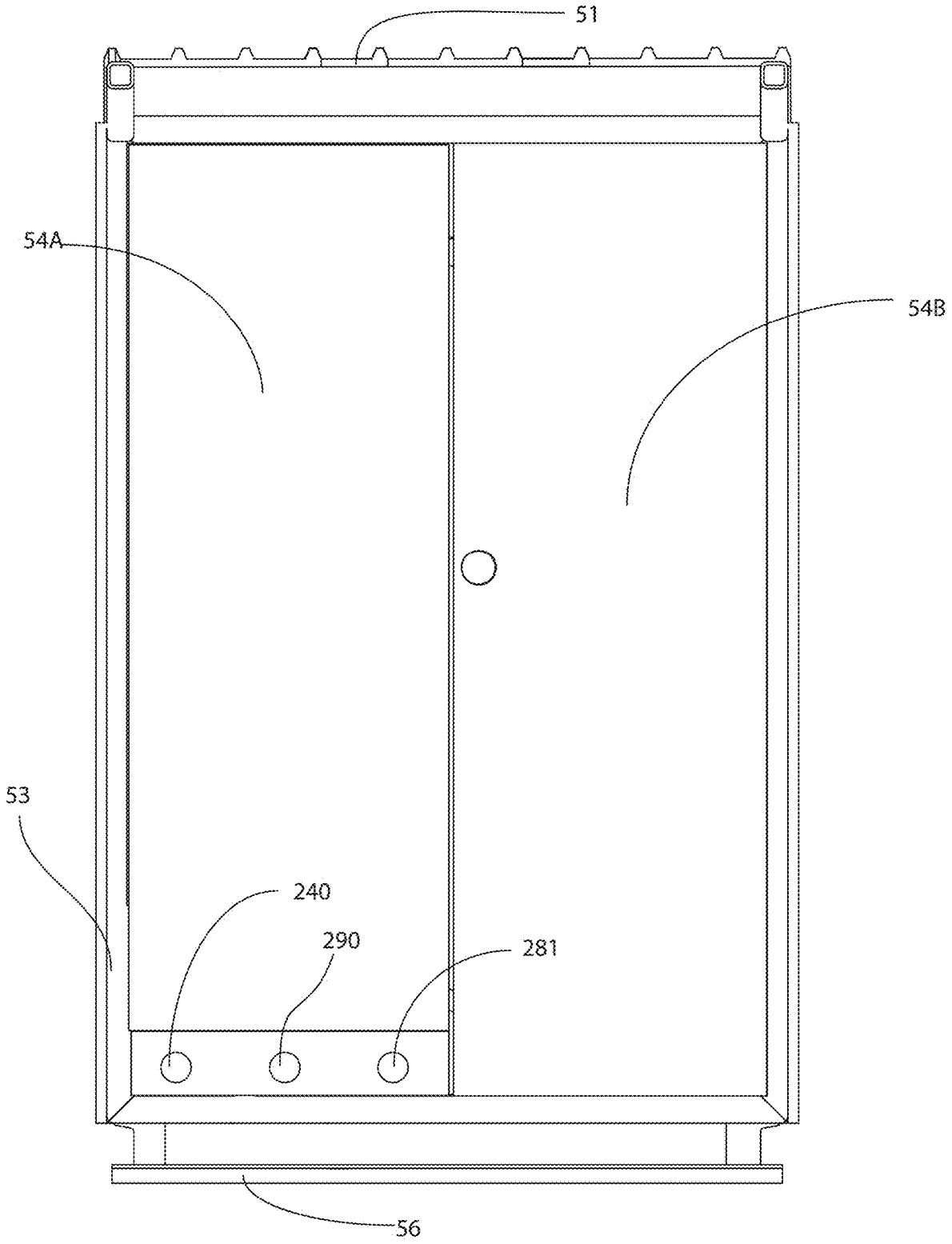
FIG. 8 is an exemplary front view of the well pump utility structure and water pumping system incorporating a quick connect and disconnect manifold, according to an embodiment of the present invention.

In some embodiments, as illustrated in FIG. 8 a quick-connect manifold 200 may be integrated into the portable well pump utility structure 50 to facilitate streamlined connections between the electrical power input line 140, water supply 181, and water output 190 conduits. In such embodiment, the manifold 200 may have a pin and sleeve type connector 240 that is operable to couple the electrical input from the grid to the electrical supply line 131 and may be independent of the electrical box 130 and may be operable to distribute electrical power uniformly to the system's components, including the system controller 120 and pump motor assembly 150, optimizing operational efficiency and reliability. The manifold may also include a water supply input connector 281 that is operable to quickly connect the water supply line 181 directly to well 80 and may efficiently manage the intake of water from the well 80, and may incorporate mechanisms such as shutoff valves, screens, and filters to ensure the water entering the system is clean and controlled. This design minimizes potential contaminants and maintains consistent water flow into the pumping system 100. The manifold 200 may further include a water output line connector 290 that is operable to connect the water output line 190 to the building 70 water supply, providing a controlled and pressurized water delivery, the manifold 200 may include pressure regulators and check valves to ensure the water is delivered at a consistent pressure, safeguarding against fluctuations and potential backflow into the system. In such embodiments, the manifold provides easy access and maintenance, with components such as isolation valves and diagnostic ports to facilitate troubleshooting and repairs without disrupting the entire system. This modular approach allows for flexibility in system configuration and expansion, accommodating various installation environments and operational demands, and facilitates rapid installation and coupling of the water pumping system 100 to the residential building 70.

It is to be understood that variations, modifications, and permutations of embodiments of the present invention, and uses thereof, may be made without departing from the scope of the invention. It is also to be understood that the present invention is not limited by the specific embodiments, descriptions, or illustrations or combinations of either components or steps disclosed herein, and that the present invention encompasses many other combinations of the various features disclosed herein. The embodiments were chosen and described in order to best explain the principles of the invention and its practical application, to thereby enable others skilled in the art to best utilize the invention and various embodiments with various modifications as are suited to the particular use contemplated. Although reference has been made to the accompanying figures, it is to be appreciated that these figures are exemplary and are not meant to limit the scope of the invention. It is intended that the scope of the invention be defined by the claims appended hereto and their equivalents.

The invention claimed is:

1. A portable well pump utility apparatus for providing water from a water well, the apparatus comprising:

a. a utility housing manufactured and assembled off-site and mounted to a skid frame, said utility housing having at least three walls, a roof, and a floor;

b. a pre-configured water pumping system secured to said utility housing, said water pumping system comprising:

i. a water intake conduit coupled to a water well and a pump and motor assembly that is operable to pump water from said water well to a pressure tank and a water output conduit, ii. a pressure transducer and a pressure relief valve coupled to said water output conduit, iii. a system controller in communication with said pressure transducer and said pump and motor assembly; and c. an electrical panel secured to said utility housing and connected to a power source through a power input electrical line, said electrical panel providing power to said system controller, wherein said skid frame is configured to elevate the utility housing off the ground to provide access for transportation equipment for positioning said utility structure at said water well and a building, wherein said building is connected to said water output conduit and said water pumping system is operable to provide a source of water to said building, wherein said skid frame is mounted to a skid plate that is operable to slide on the ground to allow for efficient adjustments to the position of said housing at a water well site, wherein said utility housing further comprises a metal frame forming a primary structure, said floor is secured inside of the said primary structure, said roof is secured to an upper roof frame, and said walls are removable secured around an exterior of the said metal frame and includes a pair of doors configured to provide technicians with access to said water pumping system for maintenance and servicing, wherein said system controller comprises a Variable Frequency Drive (VFD) system operable to provide three-phase power to said pump and motor assembly and is operable to adjust the speed of said pump and motor assembly in response to water demand from said building, thereby ensuring a consistent supply of water at a desired pressure and includes wireless communication capabilities and is in communication with a server web application and a phone application, enabling remote monitoring and management of the water pumping system, wherein said pressure transducer is coupled to said water output conduit is operable to monitor water pressure within the system continuously, wherein said system controller is operable to dynamically adjust said pump and motor assembly speed based on the pressure data received from said pressure transducer, wherein said pressure tank is operable to reduce the activation frequency of said pump and motor assembly and said pressure relief valve is operable to reduce excess pressure, and said water pumping system further includes a check valve for preventing backflow.

2. The apparatus of claim 1, wherein said water pumping system further includes a water filtration system, a water heating system, and a moisture detection sensor, each being in communication with said system controller.

3. The apparatus of claim 2, wherein said utility housing includes mounting plates for said electrical panel and said system controller, each mounting plate being coupled to a vertical member of the frame via a swivel hinge, allowing for adjustable positioning between open and closed configurations for ease of access and transportation.

4. The apparatus of claim 3, wherein said utility housing's walls are operable to be removed for maintenance and repairs and allow customization of the exterior surface finish to match environmental or aesthetic requirements.

5. The apparatus of claim 4, wherein said input conduit, said output conduit, and said power input electrical line connections are positioned on a manifold configured to allow a user to connect and disconnect said water pumping system rapidly.

* * * * *